US006206600B1

(12) United States Patent
Rosenberg et al.

(10) Patent No.: US 6,206,600 B1
(45) Date of Patent: Mar. 27, 2001

(54) COMBINATION TOOTHBRUSH AND TOOTHPASTE DISPENSER

(75) Inventors: Dorothy J. Rosenberg, 28 Huntington Cir. Dr., Medford, NJ (US) 08055-3318; Peter W. Bressler, Philadelphia, PA (US)

(73) Assignee: Dorothy J. Rosenberg, Medford, NJ (US)

( * ) Notice: Subject to any disclaimer, the term of this patent is extended or adjusted under 35 U.S.C. 154(b) by 0 days.

(21) Appl. No.: 09/442,980

(22) Filed: Nov. 18, 1999

(51) Int. Cl.[7] ..... A46B 11/04
(52) U.S. Cl. ..... 401/272; 401/153; 401/195
(58) Field of Search ..... 401/152, 153, 401/155, 170, 188 R, 195, 272, 273, 156, 187, 286, 287, 151

(56) References Cited

U.S. PATENT DOCUMENTS

| | | | | |
|---|---|---|---|---|
| 1,465,840 | | 8/1923 | Celano . | |
| 1,891,324 | | 12/1932 | Ferguson . | |
| 2,743,042 | | 4/1956 | Burgin . | |
| 3,507,599 | | 4/1970 | Meszaros et al. . | |
| 4,692,047 | * | 9/1987 | Endo | 401/141 |
| 4,693,622 | | 9/1987 | Booth . | |
| 4,733,983 | * | 3/1988 | Hertrampf | 401/146 |
| 4,787,765 | | 11/1988 | Kuo . | |
| 4,957,125 | * | 9/1990 | Yaneza | 132/309 |
| 5,348,028 | | 9/1994 | Gustavel . | |
| 5,425,591 | | 6/1995 | Contreras et al. . | |
| 5,439,014 | | 8/1995 | Moussa . | |
| 5,490,530 | | 2/1996 | Snowden . | |
| 5,769,553 | | 6/1999 | Chaudhri et al. . | |
| 5,832,940 | | 11/1998 | Embry et al. . | |
| 5,842,487 | | 12/1998 | Ledet . | |
| 6,039,489 | * | 3/2000 | Harman et al. | 401/146 |

FOREIGN PATENT DOCUMENTS

| | | | |
|---|---|---|---|
| 2633500 | 1/1990 | (FR) | H04N/1/00 |

* cited by examiner

*Primary Examiner*—Henry J. Recla
*Assistant Examiner*—Peter deVore
(74) *Attorney, Agent, or Firm*—Akin, Gump, Strauss, Hauer & Feld, L.L.P.

(57) ABSTRACT

Disclosed is a combination toothbrush and toothpaste dispenser. The toothpaste dispenser has a top and a container located therein. The container has a top and a bottom, and toothpaste located within the container. The container is compressible. The toothbrush includes a head portion which has a plurality of bristles extending therefrom and at least one hole extending thereinto. The toothbrush also includes a stem portion having a channel extending therethrough. The channel has first and second opposing ends. The first end is in fluid communication with the at least one hole and the second end is in fluid communication with the top of the container. The toothbrush is reciprocally mounted to the toothpaste dispenser, whereby reciprocation of the toothbrush relative to the toothpaste dispenser from a first position to a second position compresses the container to pump the toothpaste from the container, through the channel, and through the at least one hole and to the bristles for brushing. In one embodiment, the toothbrush is fixed at one end of the container. In another embodiment, the toothbrush is incrementally expelled from the container as the container collapses.

11 Claims, 4 Drawing Sheets

COMBINATION TOOTHBRUSH AND TOOTHPASTE DISPENSER

BACKGROUND OF THE INVENTION

It is sometimes desirable to combine a toothbrush and a toothpaste dispenser in the same article. Such a combination is ideal for travelers who generally desire to pack as few items as possible. Additionally, such a combination may be attractive for children, encouraging them to brush their teeth more often.

It is known, as disclosed in U.S. Pat No. 4,787,765, to incorporate a pump which uses a reciprocating action between a toothbrush and an integrated toothpaste dispenser to dispense toothpaste from the dispenser onto the free ends of the bristles. As a user pushes the toothbrush head into the dispenser, toothpaste is pumped from the dispenser through a nozzle and onto the bristles. U.S. Pat No. 5,096,321 discloses a combination toothbrush and toothpaste dispenser which incorporates a pump on the dispenser to pump toothpaste through a hollow cavity within the toothbrush to distribute toothpaste to the bristles. One drawback to these inventions is that the mechanisms required to pump the toothpaste are relatively complex and costly to manufacture.

It would be beneficial to provide a combination toothbrush and toothpaste dispenser which dispenses the toothpaste to the bristles through a hollow cavity within the toothbrush by means of a reciprocating pumping action of the toothbrush with respect to the toothpaste dispenser which incorporates a relatively simple operating mechanism and is inexpensive to manufacture.

BRIEF SUMMARY OF THE INVENTION

In one aspect, the present invention is a combination toothbrush and toothpaste dispenser. The combination comprises a toothpaste dispenser and a toothbrush. The toothpaste dispenser has a top and a container located therein. The container has a top and a bottom, and toothpaste located within the container. The bottom of the container is movable toward the top of the container. The toothbrush includes a head portion and a stem portion. The head portion has a plurality of bristles extending therefrom and at least one hole extending thereinto. The stem portion has a channel extending therethrough. The channel has first and second opposing ends. The first end is in fluid communication with the at least one hole and the second end is in fluid communication with the top of the container. The toothbrush is reciprocally mounted to the toothpaste dispenser, whereby reciprocation of the toothbrush relative to the toothpaste dispenser from a first position to a second position compresses the container to pump the toothpaste in a first direction from the container, through the channel, and through the at least one hole and to the bristles, and reciprocation of the toothbrush from the second position to the first position moves the bottom of the container toward the top of the toothpaste dispenser.

In a second aspect, the invention is also a combination toothbrush and toothpaste dispenser. The combination comprises a toothpaste dispenser and a toothbrush. The toothpaste dispenser includes a container. The container has a top and a bottom, and toothpaste is located within the container. The top of the container is movable toward the bottom of the container. The toothbrush includes a head portion and a stem portion. The head portion has a plurality of bristles extending therefrom and at least one hole extending thereinto. The stem portion has a channel extending therethrough. The channel has first and second opposing ends, the first end being in fluid communication with the at least one hole and the second end extending into and being in fluid communication with the container. The second end is outwardly movable from the container. The toothbrush is reciprocally mounted to the toothpaste dispenser, whereby reciprocation of the toothbrush relative to the toothpaste dispenser from a first position to a second position compresses the container to pump the toothpaste from the container, through the channel, and through the at least one hole and to the bristles, and reciprocation of the toothbrush from the second position to the first position extends the second end of the stem portion from the container.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
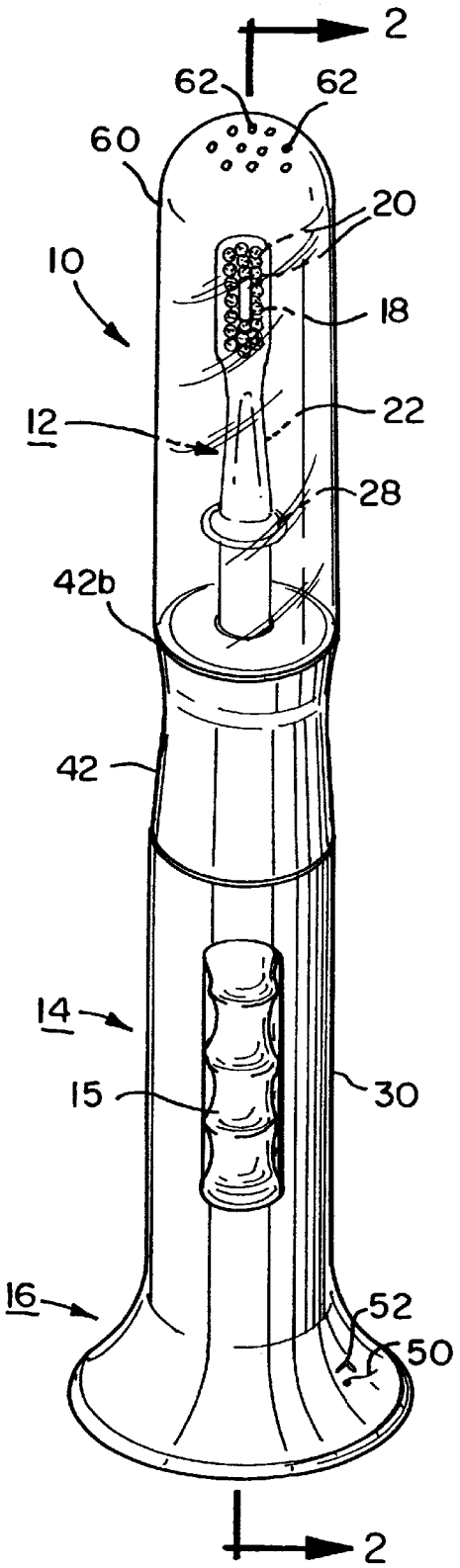
FIG. 1 is a perspective view of a first embodiment of a combination toothbrush and toothpaste dispenser according to the present invention, with the toothbrush in a first, uncompressed position.

Certain terminology is used in the following description for convenience only and is not limiting. The words "lower" and "upper" designate directions in the drawings to which reference is made. The words "inwardly" and "outwardly" refer to directions toward and away from, respectively, the geometric center of the combination toothbrush and toothpaste dispenser and designated parts thereof. The word "a" is defined to mean "at least one". The terminology includes the words above specifically mentioned, derivatives thereof and words of similar import. In the drawings, like numerals are used to indicate like elements throughout.

Figure 2:
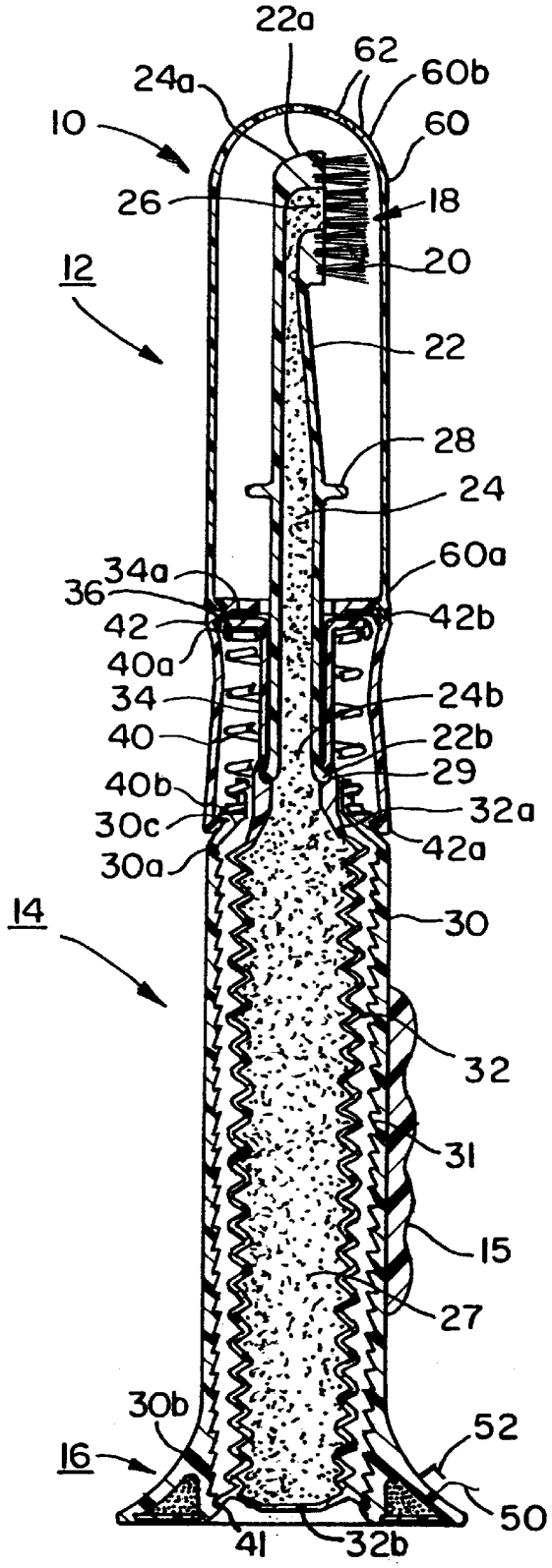
FIG. 2 is a side elevational view, in section, of the first embodiment of the combination toothbrush and toothpaste dispenser according to the present invention, taken along lines 2—2 in FIG. 1, with the toothbrush in a first, uncompressed position.
Figure 3:
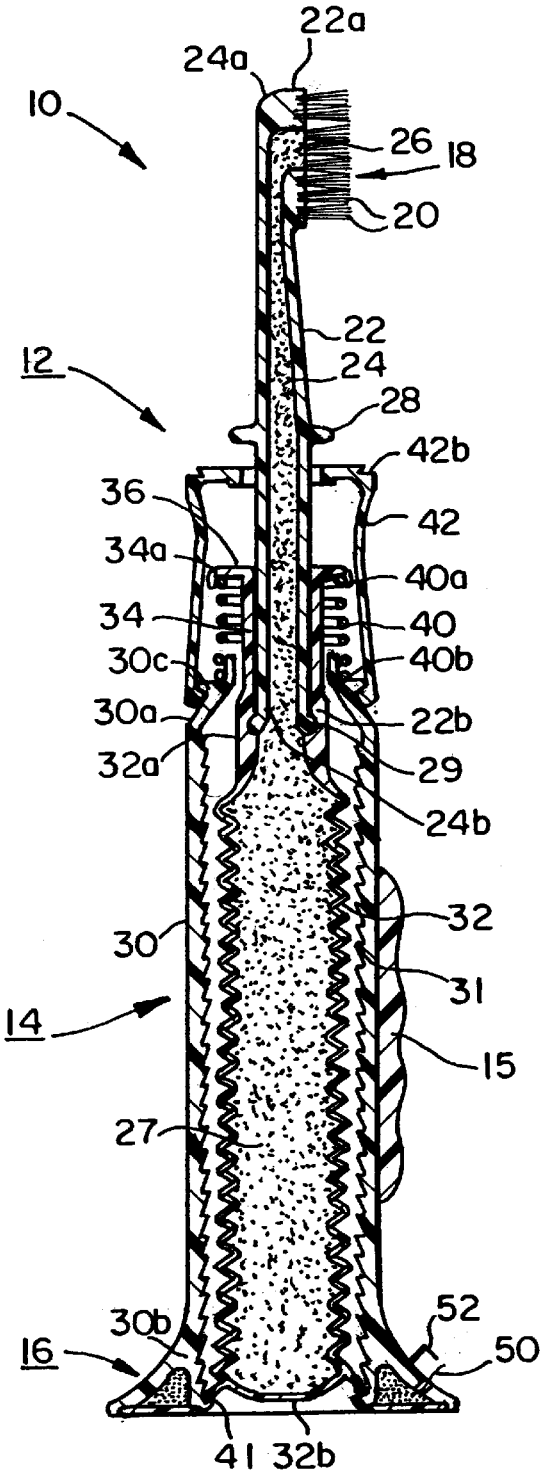
FIG. 3 is a side elevational view, in section, of the first embodiment of the combination toothbrush and toothpaste dispenser according to the present invention, with the cover removed and the toothbrush in a second, compressed position.

Referring to FIGS. 1–3, a first preferred embodiment of a combination toothbrush and toothpaste dispenser 10 (hereinafter "dispenser 10") comprises a toothbrush, generally indicated at 12, a cartridge holder, generally indicated at 14. A dental floss dispenser, generally indicated at 16, can be optionally provided.

The toothbrush 12 is similar to a conventional toothbrush, and is comprised of a head portion 18, a plurality of bristles 20 which extend from the head portion 18, and a stem portion 22. The toothbrush 12 can be a one-piece body construction with bristles 20 or can be a multi-piece body (not shown) if desired. Referring to FIG. 2, the stem portion 22 includes a first, top end 22*a*, located proximate to, and preferably forming part of, the head portion 18, and a second, bottom end 22*b*, located within the cartridge holder 14. However, unlike a conventional toothbrush, the stem portion 22 has a hollow channel 24 extending through the length of the stem portion 22. The channel 24 has a first, top end 24*a* and a second, bottom opposing end 24*b*. The top end 24*a* is in fluid communication with the head portion 18. At least one hole 26 is located on the bristle side of the head portion 18 and extends from the surface of the head portion 18 into the top end 24*a* of the channel 24 to allow toothpaste 27 to exit the channel 24 at the head portion 18 as will be discussed in more detail herein. Although a single hole 26 is preferred, those skilled in the art will realize that more than one hole 26 can be used. Preferably, the hole 26 is sufficiently large to prevent any toothpaste 27 in the hole 26 from hardening and clogging the hole 26 between uses. The stem portion 22 is open at the bottom end 24*b* of the channel 24 and is in fluid communication with toothpaste 27 in the cartridge holder 14.

As shown in FIG. 2, the stem portion 22 includes a first knob 28 extending from the exterior of the stem portion 22 between the top and bottom ends 22*a*, 22*b* for reasons that will be explained. A second knob 29 extends from the exterior of the stem portion 22 at the bottom end 22*b*. The top end of the toothbrush 12 above the knob 28 is generally longitudinally co-axial with respect to the cartridge holder 14, although those skilled in the art will realize that the toothbrush 12 can be angled, as the orientation of the top end of the toothbrush 12 with respect to the cartridge holder 14 will not affect the operation of the dispenser 10.

Preferably, the toothbrush 12 is constructed from a pliable plastic or like material that enables the toothbrush 12 to at least slightly bend without breaking, although those skilled in the art will realize that other materials can be used.

Still referring to FIG. 2, the toothbrush 12 is reciprocally mounted in the cartridge holder 14 for pump-like action from the toothbrush 12 with respect to the cartridge holder 14. The cartridge holder 14 includes a hollow shell 30 having a top end 30*a* which is preferably tapered at least slightly inward for reasons that will be explained, and a bottom end 30*b* which can be, but needs not necessarily be, open. The interior of the shell 30 includes a plurality of upwardly facing ratchet teeth 31 extending from below the top end 30*a* to the bottom end 30*b*. Preferably, the ratchet teeth 31 extend around the entire interior of the shell 30, although those skilled in the art will realize that the ratchet teeth 31 can extend only around several portions of the interior of the shell 30. Preferably, the shell 30 is made of a thermoset plastic such as a polyolefin, polyurethane, polystyrene, polycarbonate or other relatively rigid polymer. Preferably, the shell 30 is capable of being molded.

A compressible container or cartridge 32, which holds the toothpaste 27, is located within the shell 30. The cartridge 32 has an open top end 32*a* and a closed bottom end 32*b*, The cartridge 32 includes a neck 34 having a top end 34*a* located at the top of the cartridge 32 which extends above the top 30*a* of the shell 30. The neck 34 is attached to the outside of the second end 22*b* of the stem portion 22 over the second knob 29. Preferably, the neck 34 is attached to the stem portion 22 with a press or interference fit, although those skilled in the art will realize that other types of connections, such as a threaded connection, can be used.

The neck 34 preferably includes a lip 36 extending around the outer perimeter of the top end 34*a* of the neck 34. A biasing element, preferably in the form of a helical spring 40, is mounted around the exterior of the neck 34 such that a top end 40*a* of the spring 40 is engaged with the lip 36 and a bottom end 40*b* is engaged with the tapered top end 30*a* of the shell 30 as shown in FIG. 2. The spring 40 biases the toothbrush 12 to a first, generally upward, uncompressed or extended position. Preferably, the spring 40 is sized to be continuously biased between the lip 36 and the top end 30*a* of the shell 30, although those skilled in the art will realize that the spring 40 need not be continuously biased. The spring 40 allows for reciprocal motion between the toothbrush 12 and the cartridge holder 14 in a manner to be described.

The top 32*a* of the cartridge 32 is open and in fluid communication with the bottom end 24*b* of the channel 24. The bottom 32*b* of the cartridge 32 includes at least one tang 41 extending generally axially/downwardly and radially/outwardly from the exterior of the bottom 32*b* of the cartridge 32. The bottom 32*b* of the cartridge 32 is upwardly movable along the length of the shell 30 toward the top 32*a*. The at least one tang 41 engages with the ratchet teeth 31 on the shell 30 in a manner which will be explained.

Preferably, the cartridge 32 is generally accordion shaped to reduce its interior volume when compressed, although those skilled in the art will realize that the cartridge 32 can be other shapes, as long as the cartridge 32 reduces in interior volume when compressed. The cartridge 32 is preferably constructed from a polymeric material, although those skilled in the art will realize that other materials can be used. The neck 34 is preferably made from the same material as the cartridge 32, but is preferably thicker than the wall of the cartridge 32 so as to be relatively incompressible relative to the cartridge 32.

A cap 42 is located on the first end 30*a* of the shell 30, exterior of the spring 40 and the lip 36 and houses the spring 40 and the lip 36. Preferably, the cap 42 is snapped onto the shell 30 such that a lip 42*a* in the cap 42 engages a tang 30*c* at the top of the shell 30, although those skilled in the art will realize that the cap 42 can be affixed to the shell 30 by other methods, including but not limited to, a threaded connection.

The dental floss dispenser 16 is mounted on the cartridge holder 14 proximate to the bottom of the dispenser 10, allowing the user to draw a desired length of dental floss 50 from the dispenser 16 and sever the dental floss 50 at a cutter 52. Construction of dental floss dispensers is well known and is not an object of the present invention. Those skilled in the art will realize that the dental floss dispenser 16 is optional and need not be installed in the dispenser 10.

As shown in FIGS. 1 and 2, the toothbrush 12 is removably insertable into an open end of a transparent, generally elongated hollow cover 60 such that an open end 60*a* of the cover 60 is releasably attachable to the cap 42. Preferably, the cap 42 includes a circumferential lip 42*b* which interferingly, yet releasingly, engages the open end 60*a* of the cover 60. The cover 60 preferably includes a plurality of air holes 62 located through a closed end 60*b* to release moisture from inside the cover 60 and reduce the build up of mildew on the toothbrush 12.

The shell 30 is configured to allow a user to pick up the dispenser 10 by the shell 30 and hold the shell 30 while brushing his/her teeth. The exterior of the shell 30 can include a formed grip 15 for children or others who may have trouble gripping the shell 30. The formed grip 15 may be shaped to include individual gripping tracks for each finger. Preferably, the formed grip 15 is made of a soft plastic or rubber to enable the user to firmly grip the exterior of the shell 30, especially if the shell 30 is wet, as may be the case. The grip 15 can be a separate member, as shown, affixed by suitable means (e.g. adhesive or solvent weld or mechanical fastener) or molded as part of the shell 30. The bottom end 30*b* of the shell 30 (or the floss dispenser 16, if used) can act as a base for the dispenser 10, which allows the dispenser 10 to stand vertically on a surface S, as shown in FIGS. 2 and 3.

Preferably, the cartridge 32 contains a predetermined maximum amount of toothpaste 27 such that the dispenser 10 is disposable. More preferably, the cartridge 32 is sized to contain at least eight (8) ounces (226 grams) of toothpaste 27. However, the amount of toothpaste 27 contained within the cartridge 32 is not limiting. Those skilled in the art will realize that the toothpaste 27 can be in either paste or gel form, as long as the toothpaste 27 is sufficiently viscous to allow the toothpaste 27 to generally remain in the channel 24 after being pumped into the channel 24 and not flow back into the cartridge 32.

Preferably, the toothbrush 12 and the cartridge holder 14 are a single unit and the entire combination can be thrown away after the toothpaste 27 is exhausted from the cartridge 32. However, those skilled in the art will realize that the toothbrush 12 can be separable from the cartridge holder 14 for connection to a second cartridge holder (not shown) when the toothpaste 27 in the cartridge 32 has been exhausted.

Operation of the dispenser 10 is as follows. Initially, the dispenser 10 in the condition as seen in FIG. 2. To use the dispenser 10, the user removes the cap 60 from the dispenser 10. The user then pumps the toothbrush 12 in and out (upward and downward) of the cartridge holder 14. Initially, the user may have to pump the toothbrush 12 several times to fill the channel 24 before toothpaste 27 is seen at the bristles 20.

When the toothbrush 12 is pumped down into the cartridge holder 14, the cartridge 32 is compressed, reducing the interior volume of the cartridge 32. The knob 28 on the stem portion 22 prevents the toothbrush 12 from being pushed into the cartridge holder 14 more than a desired amount. The at least one tang 41, which is engaged with a ratchet tooth 31, prevents the bottom 32*b* of the cartridge 32 from moving downward as the stem portion 22 is pushed downward. Preferably, the cartridge 32 is compressed along the accordion lines of the cartridge 32, although those skilled in the art will realize that the cartridge 32 need not be compressed along accordion lines, as long as the cartridge 32 is compressed. Toothpaste 27 in the cartridge 32 is pumped upward and into the second end 24*b* of the channel 24. The toothpaste 27 or any toothpaste already in the channel 24 is forced up the channel 24, through the at least one hole 26, and is dispensed to the bristles 20 for brushing.

When the toothbrush 12 is pushed down, as shown in FIG. 3, the tapered first end 30*a* of the shell 30 prevents movement of the spring 40 past the first end 30*a* of the shell 30, compressing the spring 40 between the first end 30*a* of the shell 30 and the lip 36, storing energy in the spring 40. Pulling the toothbrush 12 up or, alternatively, allowing the energy stored in the spring 40 to push the toothbrush 12 up, draws the entire cartridge 32 upward. The toothpaste 27 in the channel 24 prevents air from entering the cartridge 32 through the channel 24 and subsequently prevents the cartridge 32 from expanding. As the cartridge 32 moves upward, the at least one tang 41 rides up at least one ratchet tooth 31. Subsequent operation of the dispenser 10 further compresses the container 32 and discharges toothpaste 27 up the stem portion 22 to the bristles 20. If desired, the user can pull dental floss 50 from the dental floss dispenser 16 for use in flossing by removing a length of dental floss 50 from the dispenser 16 by using the cutter 52 in a known manner.

Figure 4:
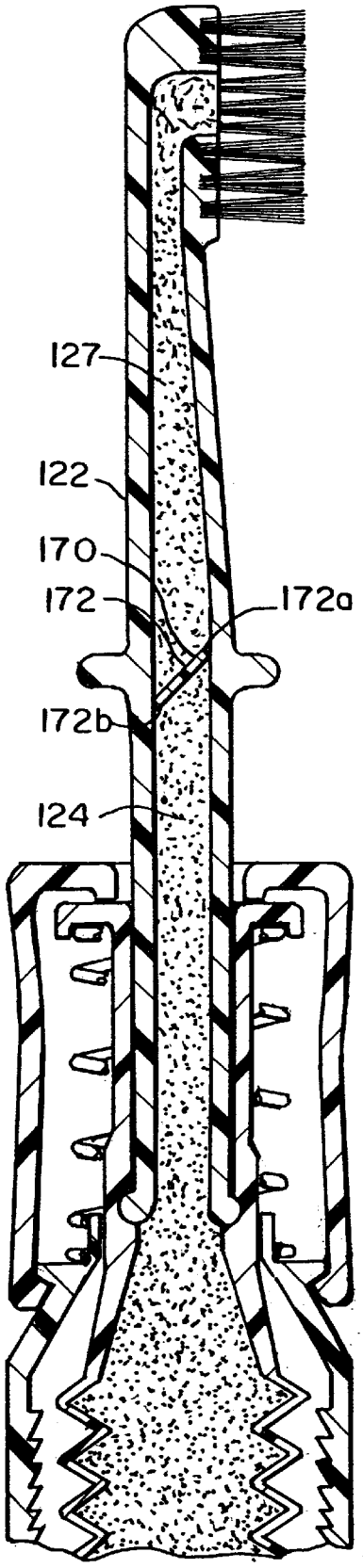
FIG. 4 is an enlarged partial side elevational view, in section, of an alternate version of the first embodiment of the combination toothbrush and toothpaste dispenser, with the cover removed and with a flapper valve in an open position.
Figure 5:
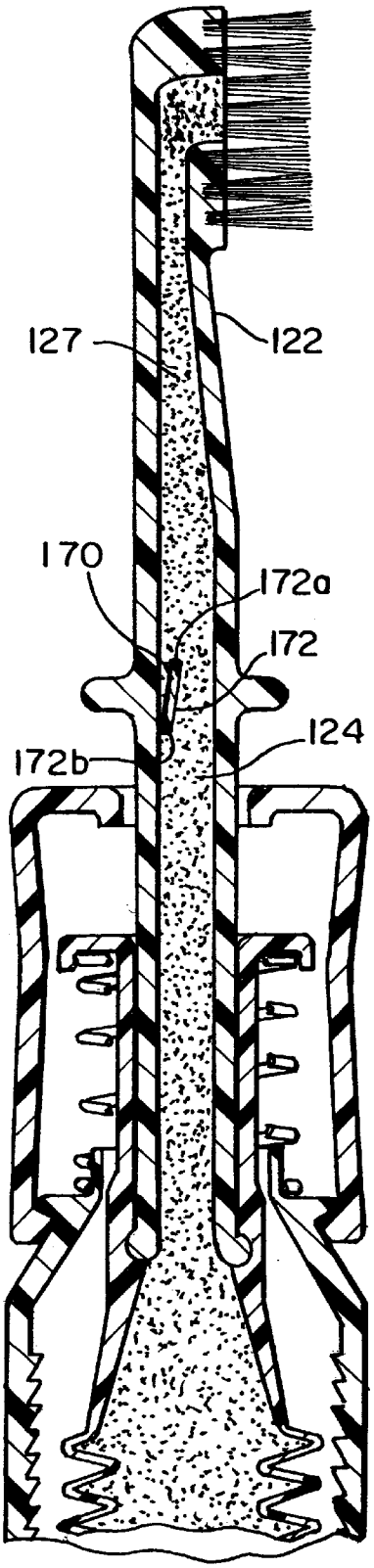
FIG. 5 is an enlarged partial side elevational view, in section, of the alternate version of the first embodiment of the combination toothbrush and toothpaste dispenser, with the cover removed and with the flapper valve in a closed position.

In an alternate version of the first embodiment, as shown in FIGS. 4 and 5, a check valve 170 can be installed in a channel 124 located within a stem portion 122 to ensure that toothpaste 127 that is pumped above the check valve 170 is not drawn back into a cartridge 132 when the toothbrush 112 moves to the second position. The check valve 170 includes a flapper 172 having a free end 172*a* and a fixed end 172*b*. Although not shown, the stem portion 122 can be made from a plurality of pieces to facilitate insertion of the check valve 170 into the stem portion 122.

Operation of the alternate version of the first embodiment is similar to the operation of the first version of the first embodiment as described above, with the added feature that, as the toothbrush 112 is compressed from an initial position as shown in FIG. 4, the flapper 172 pivots about the fixed end 172*b* and the free end 172*a* is forced upward to an open position as shown in FIG. 5, opening a path of fluid communication through the channel 124 from the container 132, past the flapper 172, to bristles 120. When the toothbrush 112 is released, the toothbrush 112 begins to return to its initial position from the compressed position and any suction forces which may be created in the cartridge 132 by the toothbrush 112 returning to its original position draw the toothpaste 127 located above the flapper 172 in the channel 124 downward. The toothpaste 127 in the channel 124 above the flapper 172 acts to close the flapper 172 to its original position. As the toothbrush 112 continues to return to its initial position, the entire cartridge 132 is pulled up the shell 130 in a manner similar to the manner described in the first version of the first embodiment. Toothpaste 127 in the channel 124 above the flapper 172 is not drawn back into the cartridge 132.

Figure 6:
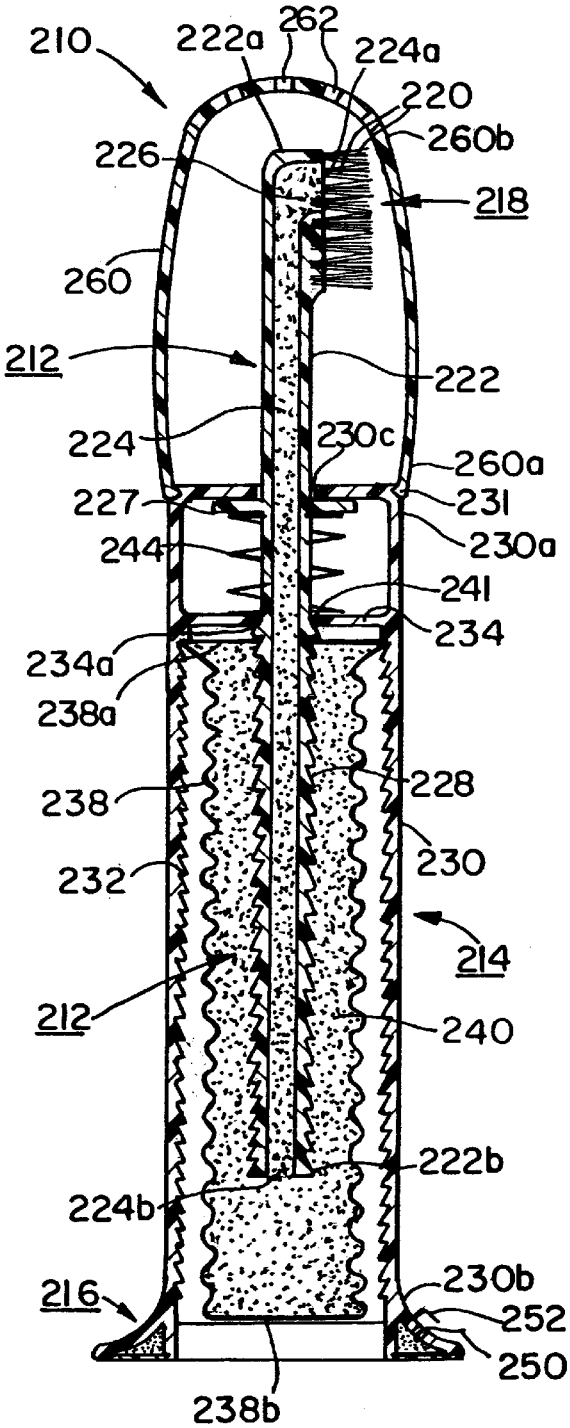
FIG. 6 is a side elevational view, in section, of a second embodiment of the combination toothbrush and toothpaste dispenser according to the present invention, with the dispenser full.
Figure 7:
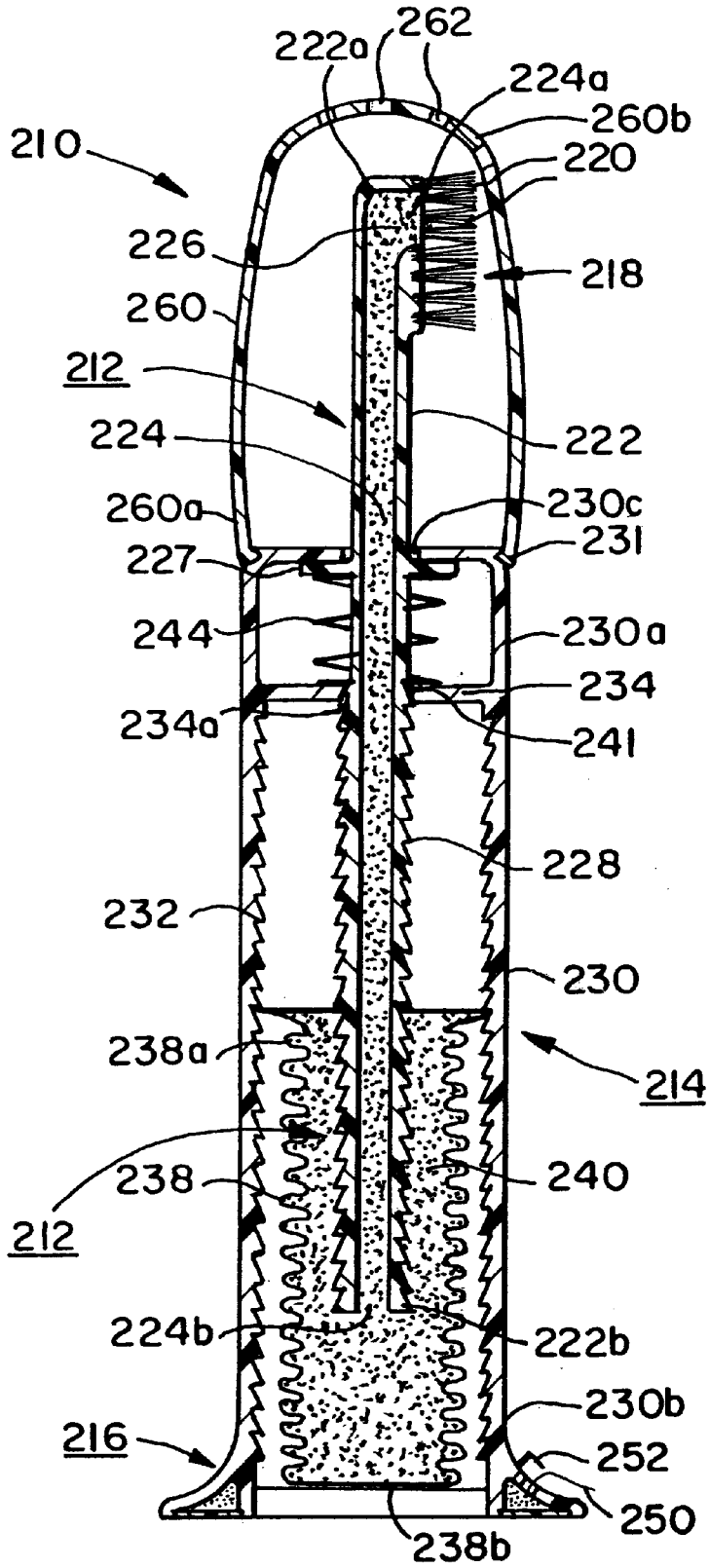
FIG. 7 is a side elevational view, in section, of the second embodiment of the combination toothbrush and toothpaste dispenser according to the present invention, with the dispenser partially used.

A second embodiment of the combination toothbrush and toothpaste dispenser, generally indicated as 210, is shown in FIGS. 6 and 7. The dispenser 210 includes a toothbrush 212 and a cartridge holder 214. A floss dispenser 216 can be fixed to the bottom of cartridge holder 214, or alternatively omitted, as described above in the description of the first embodiment. The toothbrush 212 includes a head portion 218 with a plurality of bristles 220 extending therefrom. The toothbrush 212 also includes a stem portion 222 having a first, top end 222*a* fixedly connected to, and forming part of, the head portion 218 and a second, bottom end 222*b*, located distal from the top end 222*a*. A channel 224 having a first, top end 224*a* and an opposing, second, bottom end 224*b* extends through the stem portion 222. The head portion 218 includes at least one dispensing hole 226 extending thereinto which fluidly communicates the top end 224*a* of the channel 224 to the bristles 220. However, those skilled in the art will realize that more than one dispensing hole 226 can be used.

A retainer 227 is located on the outer perimeter of the stem portion 222 within the dispenser 214. Preferably, the retainer 227 is generally annular, although those skilled in the art will realize that the retainer 227 can be other shapes. The outer perimeter of the stem portion 222, proximate to the second end 222*b*, includes a plurality of downwardly facing ratchet teeth 228. The stem portion 222 is long enough to extend into the dispenser 214, but short enough to allow the stem portion 222 to reciprocate in the dispenser 214 as will be discussed.

The dispenser 214 includes a generally annular hollow shell 230 which has a generally closed top end 230*a* having an opening 230*c* through which the stem portion 222 extends, and a closed bottom end 230*b*. The exterior of the top end 230*a* includes a circumferential lip 231 to releasably secure a cover. The shell 230 includes a plurality of downwardly facing ratchet teeth 232 located around an inner perimeter thereof. Preferably, the ratchet teeth 232 extend around the entire interior of the shell 230, although those skilled in the art will realize that the ratchet teeth 232 can extend only around several portions of the interior of the shell 230. The interior of the shell 230 also includes a shelf 234 extending inward from the interior perimeter of the shell 230. The shelf 234 is located between the retainer 227 and a toothpaste cartridge 238. Preferably, the shelf 234 is generally annular, although those skilled in the art will realize that the shelf 234 can be other shapes, as well. The shelf 234 includes a central opening 234*a* located as shown in FIG. 6, which is generally co-axial with the opening 230*c* and which is sized to allow the stem portion 222 to reciprocate therethrough. The bottom end 230*b* of the shell 230 (or the floss dispenser 216, if used) can act as a base for the dispenser 210, which allows the dispenser 210 to stand vertically, as shown in FIGS. 6 and 7.

The toothpaste cartridge 238 having a top end 238*a* and a bottom end 238*b* and containing toothpaste 240 is located within the shell 230. The bottom end 224*b* of the channel 224 extends into and is in fluid communication with the cartridge 238. The bottom end 222*b* of the stem portion 222 is outwardly movable from the container 238 in a manner to be further explained later herein. The top end 238*a* of the cartridge 238 is outwardly flared to engage the ratchet teeth 232 on the shell 230. Preferably, the top end 238*a* of the cartridge 238 is flared around the entire perimeter of the top end 238*a*, but those skilled in the art will realize that the top end 238*a* can be flared around only part of the perimeter, as long as the top end 238*a* is engageable with the ratchet teeth 232 on the shell 230. The top end 238*a* also includes an opening 241 generally co-axial with the opening 234*a* of the shelf 234 through which the stem portion 222 of the toothbrush 212 extends. The opening 241 is sized to generally seal the stem portion 222 passing therethrough, but also to allow the ratchet teeth 228 on the stem portion 222 to be pulled upward through the opening 241 during an upward stroke of the toothbrush 212, but to not allow the ratchet teeth 228 on the stem portion 222 to be pushed into the opening 241 during a downward stroke of the toothbrush 212. The cartridge 238 is collapsible such that the top 238*a* of the cartridge 238 is movable toward the bottom 238*b* of the cartridge 238. As shown in FIGS. 6 and 7, the cartridge 238 is preferably accordion shaped, but those skilled in the art will realize that the cartridge 238 can be other configurations, as long as the cartridge 238 collapses when compressed.

A helical spring 244 is located within the shell 230 between the retainer 227 and the shelf 234. The stem portion 222 is disposed inside the spring 244 along a longitudinal axis of the spring 244. The spring 244 biases the toothbrush 212 to a first upward position.

Dental floss 250 is located within and is dispensable from the dental floss dispenser 216 as described above in the first embodiment. The floss 250 is severable from the floss dispenser 216 by a floss cutter 252, as is well known in the art.

A transparent, generally elongated hollow cover 260 having a free end 260*a* and a closed end 260*b* with a plurality of air holes 262 in the closed end 260*b* is releasably attachable to the cartridge holder 214. Preferably, the open end 260*a* of the cover 260 engages the lip 231 on the top end 230*a* of the shell 230 in an interfering, yet easily separable relationship, although those skilled in the art will realize that other connections can be used.

Preferably, the dispenser 210 in constructed of the same materials as the dispenser 10 as described above, although those skilled in the art will realize that the dispenser 210 can be constructed from other materials as well.

Operation of the second embodiment of the dispenser 210 will now be discussed. The cover 260 is removed from the shell 230. To dispense toothpaste 240 from the cartridge 238 to the bristles 220, the user pushes down on the toothbrush 212 relative to the cartridge holder 214, moving the toothbrush 212 from the first position to a second, downward, compressed position. The retainer 227 compresses the spring 244 between the retainer 227 and the shelf 234, storing energy in the spring 244. The ratchet tooth 228 of the stem portion 222 which is engaged with the top end 238*a* of the cartridge 238 pushes down on the top end 238*a* of the cartridge 238, compressing the cartridge 238. The flared top end 238*a* of the cartridge 238 moves down at least one shell ratchet 232, reducing the interior volume of the cartridge 238, and forcing toothpaste 240 to be pumped from the cartridge 238 into the bottom end 224*b* of the channel 224. The toothpaste 240 travels up the channel 224 from the bottom end 224*b* to the top end 224*a*, out the at least one dispensing hole 226, and to the bristles 220 for brushing.

When the toothbrush 212 is released relative to the cartridge holder 214, the energy stored in the spring 244 forces the toothbrush 212 upward and outward relative to the cartridge holder 214 to the first position by acting against the retainer 227 and the shelf 234. The shell ratchet tooth 232 which is engaged with the flared top 238*a* of the cartridge 238 prevents the cartridge 238 from expanding. As the toothbrush 212 moves upward relative to the cartridge holder 214, at least one stem ratchet tooth 228 extends from the opening 241 in the cartridge 238, returning the toothbrush 212 to its first, upward position relative to the cartridge holder 214.

Subsequent pumps of the toothbrush 212 relative to the cartridge holder 214 repeat the process described above, sequentially compressing the cartridge 238 downward in the shell 230 from the top 238*a* of the cartridge 238.

Dental floss 250 can be dispensed from the dental floss dispenser 216 in a known fashion, and the floss 250 can be separated from the dispenser 216 by using the floss cutter 252 in a known manner.

Preferably sized for adults, a smaller version of the dispenser 10, 210 can be produced on a smaller scale for children, and can be provided without the dental floss dispenser 16, 216. Additionally, the dispenser 10, 210 as disclosed herein is ideal for traveling. A smaller version of the dispenser (not shown), containing approximately two (2) to four (4) ounces (57 to 113 grams) of toothpaste, can be sized to fit into a typical shaving or travel bag. However, those skilled in the art will realize that other volumes of toothpaste can be used without departing from the spirit and scope of the present invention.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

What is claimed is:

1. A combination toothbrush and toothpaste dispenser, the combination comprising:

a toothpaste dispenser having a top and a container located therein, the container having a top and a bottom, and toothpaste located within the container, the bottom of the container being movable toward the top of the container;

a toothbrush including a head portion and a stem portion, the head portion having a plurality of bristles extending therefrom and at least one hole extending thereinto, the stem portion having a channel extending therethrough, the channel having first and second opposing ends, the first end being in fluid communication with the at least one hole and the second end being in fluid communication with the top of the container, the toothbrush being reciprocally mounted to the toothpaste dispenser, whereby reciprocation of the toothbrush relative to the toothpaste dispenser from a first position to a second position compresses the container to pump the toothpaste in a first direction from the container, through the channel, and through the at least one hole and to the bristles, and reciprocation of the toothbrush from the second position to the first position moves the bottom of the container toward the top of the toothpaste dispenser.

2. The combination according to claim 1, wherein the toothbrush is biased to the first position.

3. The combination according to claim 1, wherein the toothpaste dispenser further comprises a base.

4. The combination according to claim 3, wherein the toothpaste dispenser further comprises a dental floss dispenser mounted on the base.

5. The combination according to claim 1, further comprising a generally elongated hollow cover having a closed end and an open end, the toothbrush being insertable into the open end, the open end being releasably mountable to the toothpaste dispenser, the closed end having a plurality of holes therethrough.

6. The combination according to claim 1, further including a valve located in the channel, the valve preventing flow of toothpaste in a second direction.

7. A combination toothbrush and toothpaste dispenser, the combination comprising:

a toothpaste dispenser including a container, the container having a top and a bottom, and toothpaste located within the container, the top of the container being movable toward the bottom of the container; and a toothbrush including a head portion and a stem portion, the head portion having a plurality of bristles extending therefrom and at least one hole extending thereinto, the stem portion having a channel extending therethrough, the channel having first and second opposing ends, the first end being in fluid communication with the at least one hole and the second end extending into and being in fluid communication with the container, the second end being outwardly movable from the container, the toothbrush being reciprocally mounted to the toothpaste dispenser, whereby reciprocation of the toothbrush relative to the toothpaste dispenser from a first position to a second position compresses the container to pump the toothpaste from the container, through the channel, and through the at least one hole and to the bristles, and reciprocation of the toothbrush from the second position to the first position extends the second end of the stem portion from the container.

8. The combination according to claim 7, wherein the toothbrush is biased to the first position.

9. The combination according to claim 7, wherein the toothpaste dispenser further comprises a base.

10. The combination according to claim 9, wherein the toothpaste dispenser further comprises a dental floss dispenser mounted on the base.

11. The combination according to claim 7, further comprising a generally elongated hollow cover having a closed end and an open end, the toothbrush being insertable into the open end, the open end being releasably mountable to the toothpaste dispenser, the closed end having a plurality of holes therethrough.

* * * * *